US008352280B2

(12) United States Patent
Myburg et al.

(10) Patent No.: US 8,352,280 B2
(45) Date of Patent: Jan. 8, 2013

(54) SCALABLE MULTI-CHANNEL AUDIO CODING

(76) Inventors: Francois Philippus Myburg, Eindhoven (NL); Erik Gosuinus Petrus Schuijers, Eindhoven (NL)

( * ) Notice: Subject to any disclaimer, the term of this patent is extended or adjusted under 35 U.S.C. 154(b) by 0 days.

(21) Appl. No.: 13/226,525

(22) Filed: Sep. 7, 2011

(65) Prior Publication Data

US 2012/0063604 A1 Mar. 15, 2012

Related U.S. Application Data

(62) Division of application No. 11/909,741, filed on Sep. 26, 2007, now Pat. No. 8,036,904.

(30) Foreign Application Priority Data

Mar. 30, 2005 (EP) ..... 05102506
Apr. 18, 2005 (EP) ..... 05103077

(51) Int. Cl.
*G10L 19/00* (2006.01)

(52) U.S. Cl. ..... 704/500; 704/200; 704/201; 704/501

(58) Field of Classification Search ..... 704/200–201, 704/500–501
See application file for complete search history.

(56) References Cited

U.S. PATENT DOCUMENTS

| | | | | |
|---|---|---|---|---|
| 7,646,875 | B2 * | 1/2010 | Schuijers et al. | 381/23 |
| 2002/0067834 | A1 * | 6/2002 | Shirayanagi | 381/20 |
| 2005/0149322 | A1 * | 7/2005 | Bruhn et al. | 704/211 |
| 2005/0180579 | A1 * | 8/2005 | Baumgarte et al. | 381/63 |
| 2006/0085200 | A1 * | 4/2006 | Allamanche et al. | 704/500 |
| 2006/0133618 | A1 * | 6/2006 | Villemoes et al. | 381/20 |
| 2006/0165184 | A1 * | 7/2006 | Purnhagen et al. | 375/242 |
| 2006/0190247 | A1 * | 8/2006 | Lindblom | 704/230 |
| 2007/0055510 | A1 * | 3/2007 | Hilpert et al. | 704/230 |
| 2008/0126104 | A1 * | 5/2008 | Seefeldt et al. | 704/503 |
| 2008/0170711 | A1 * | 7/2008 | Breebaart et al. | 381/77 |

FOREIGN PATENT DOCUMENTS

| | | | |
|---|---|---|---|
| EP | 0918407 | A2 | 5/1995 |
| EP | 1376538 | A1 | 1/2004 |
| WO | 2004008805 | A1 | 10/2004 |

OTHER PUBLICATIONS

Faller, C.:"Coding of Spatial Audio Compatible With Different Playback Formats", AES Convention Paper, AES 117th Convention, San Francisco, USA, Oct. 28-31, 2004.

* cited by examiner

*Primary Examiner* — Douglas Godbold

(57) ABSTRACT

An audio encoder adapted to encode a multi-channel audio signal. The encoder comprises an encoder combination module (ECM) for generating a dominant signal part and a residual signal part being a combined representation of first and second audio signals, the dominant and residual signal parts being obtained by applying a mathematical procedure to the first and second audio signals. The mathematical procedure involves a spatial parameter comprising a description of spatial properties of the first and second audio signals. Embodiments include a plurality of interconnected encoder combination module, so that e.g. six independent 5.1 format audio signals can be encoded to a single or two dominant signal parts and a number of parameter sets and residual signal parts.

12 Claims, 6 Drawing Sheets

SCALABLE MULTI-CHANNEL AUDIO CODING

This is a divisional application of U.S. patent application Ser. No. 11/909,741, filed Sep. 26, 2007.

The invention relates to the field of high quality audio coding. Especially, the invention relates to the field of high quality coding of multi-channel audio data. More specifically, the invention defines encoders and decoders and methods for encoding and decoding multi-channel audio data.

Figure 1:
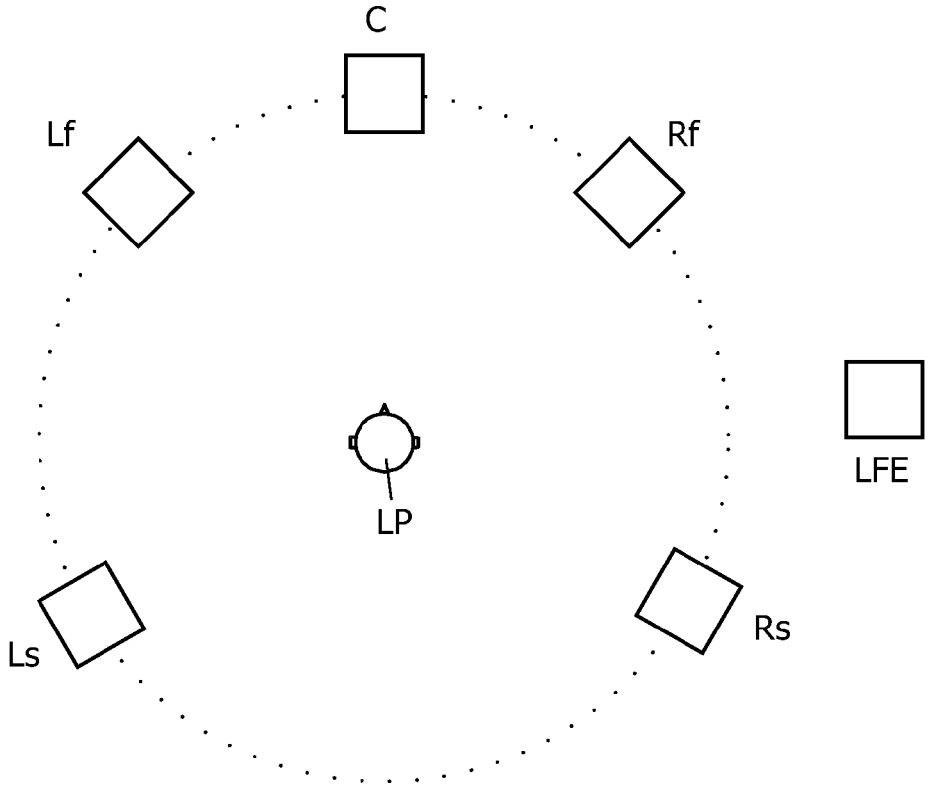

Although many multi-channel configurations/set-ups are possible, the 5.1 configuration/set-up is the most popular (see also FIG. 1). The typical multi-channel 5.1 setup consists of five speakers, namely left front (Lf), right front (Rf), centre (C), left surround (Ls), and right surround (Rs) speakers complemented by an additional LFE (low frequency enhancement) speaker to be placed at an arbitrary angle. In the past several approaches for compressing multi-channel audio data, such as the 5.1 multi-channel audio data have been considered. A brief overview is given below.

In the MPEG-2 Audio standard, ISO/IEC 13818-3:1998 Information technology—Generic coding of moving pictures and associated audio information—Part 3: Audio, a provision is made for coding multi-channel audio while maintaining backward compatibility towards MPEG-1 Audio, ISO/IEC 11172-3:1993 Information technology—Coding of moving pictures and associated audio for digital storage media at up to about 1.5 Mbit/s—Part 3: Audio, which caters only for the coding of mono and stereo audio. Backward compatibility is achieved by forming a basic stereo signal, derived from the multi-channel content, which is placed in the Data part of the MPEG-1 bit stream. Three additional signals are then placed in the Ancillary Data part of the MPEG-1 bit stream. This technique is referred to as matrixing. An MPEG-1 Audio decoder can generate a meaningful stereo signal (Lo, Ro) from the bit stream, while an MPEG-2 Audio decoder can extract the additional channels and reconstruct a decoded version of the 5 input channels. Backward compatibility comes at the cost of a high bit rate. Typically, a bit rate of 640 kbit/s is required to obtain a high audio quality for five channel material with MPEG-2 Layer II.

In MPEG-2 Advanced Audio Coding (AAC), ISO/IEC TR 13818-5:1997/Amd 1:1999 Advanced Audio Coding (AAC), multi-channel audio is coded in a non-backward compatible format. This allows the coder more freedom and has the advantage that a higher audio quality (transparent) can be achieved at a bit rate of 320 kbit/s, compared to MPEG-2 Layer II at 640 kbit/s. In a 5(0.1) channel configuration, AAC may code the channel pairs that are symmetric to the listener by means of employing the Mid-Side (MS) stereo tool: (Lf, Rf) and (Ls, Rs). The centre (C) and (optional) LFE channels are coded separately. Alternatively, Intensity Stereo (IS) coding can be employed to combine several audio channels into one channel, and additionally providing scaling information for each channel.

In parametric multi-channel audio coding, perceptually relevant cues (or spatial parameters), such as inter-channel intensity differences (IID), inter-channel time differences (ITD) and inter-channel coherence (ICC), are measured between channels in a multi-channel signal. A more thorough description of spatial parameters may be found in Christof Faller: "Coding of Spatial Audio Compatible with Different Playback Formats", AES Convention Paper, AES 117$^{th}$ Convention, San Francisco, USA, 2004 Oct. 28-31. Furthermore, the multi-channel representation is down-mixed to a stereo or mono signal that can be encoded with a standard mono or stereo encoder. An important requirement is that the stereo or mono down-mix should be of a sufficient audio quality, e.g. at least comparable to the ITU-R Recommendation BS.775-1 down-mix. The transmitted information thus comprises a coded version of the mono or stereo signal and the spatial parameters. The mono or stereo down-mix is coded at a bit rate substantially lower than that required for coding the original multi-channel audio signal, and the spatial parameters require a very small transmission bandwidth. Therefore, the down-mix and spatial parameters can be coded at a total bit rate that is only a fraction of the bit rate required when all channels are coded. The parametric decoder generates a high-quality approximation of the original multi-channel audio signal from the transmitted mono or stereo down-mix and spatial parameters.

It may be seen as an object of the present invention to provide a scalable multi-channel audio signal encoder that provides a high efficiency, provides a high signal quality and at the same time provides an encoded signal that is back-ward compatible.

According to a first aspect, the invention provides an audio encoder adapted to encode a multi-channel audio signal, the encoder comprising:

an encoder combination module for generating a dominant signal part and a residual signal part being a combined representation of first and second audio signals, the dominant and residual signal parts being obtained by applying a mathematical procedure to the first and second audio signals, wherein the mathematical procedure involves a first spatial parameter comprising a description of spatial properties of the first and second audio signals, a parameter generator for generating a first parameter set comprising a second spatial parameter, and a second parameter set comprising a third spatial parameter, and an output generator for generating an encoded output signal comprising a first output part comprising the dominant signal part and the first parameter set, and a second output part comprising the residual signal part and the second parameter set.

In the encoder combination module, first and second audio signals are combined into dominant and residual signal parts. By "dominant and residual signal parts" are understood two audio signals where the dominant signal contains the dominant or major parts of the first and second audio signals, while the residual signal contains a residual or less significant part of the first and second audio signals. By "spatial parameter" is understood a parameter that can be mathematically expressed and based on or derived from one or more spatial properties of a signal pair. A non-exhaustive list of such spatial properties that can be calculated are: inter-channel intensity differences (IID), inter-channel time differences (ITD) and inter-channel coherence (ICC). The encoder combination module preferably generates the dominant and residual signal parts such that these signal parts are less correlated than the first and second audio signals. Preferably, the dominant and residual signal parts are generated so that they are not correlated, i.e. orthogonal, or at least they should be as least correlated as possible.

The residual signal part may be low pass filtered before being converted into an output bit stream, in order to be represented in a bit stream thus requiring only a very limited amount of bit rate. A cut off frequency for such low pass filtering may be in the interval 500 Hz to 10 kHz, e.g. 2 kHz.

The encoder combination module may be adapted to combine first, second and third audio signals to first and second dominant signal parts instead of combining two audio signals into one dominant signal, such as described above.

The encoder according to the first aspect provides a scalable encoded representation of the first and second audio signals. Using the first output part, or base layer part, it is possible to decode the first and second audio signals with an acceptable resulting sound quality by using existing decoders. However, by using a decoder capable of utilizing the second output part, or refinement layer part, it is possible to obtain a higher signal quality. Thus, the second output part can be seen as optional and is only necessary in case the best possible sound quality is desired.

In a preferred embodiment, the residual signal part comprises a difference between the first and second audio signals. The residual signal part may be defined precisely as a difference between the first and second audio signals.

In preferred embodiments, the mathematical procedure comprises a rotation in a two-dimensional signal space.

The third spatial parameter may comprise a difference between the second spatial parameter and the first spatial parameter. The third spatial parameter may involve differential coding.

The second spatial parameter may comprise a coherence based ICC parameter. The third spatial parameter may comprise a difference between a coherence based ICC parameter and a correlation based ICC parameter. In a preferred embodiment, the second spatial parameter comprises a coherence based ICC parameter, while the third spatial parameter comprises a difference between the second spatial parameter and a correlation based ICC parameter.

The encoder may further be adapted to encode a third, a fourth, a fifth and a sixth or even more audio signals according to the principles of the first aspect by combining these audio signals together with the first and second audio signals and generate the first and second output parts in response thereto. Preferably, such encoder is adapted to encode a 5.1 audio signal by using a configuration comprising a plurality of the encoder combination modules. In principle, the encoder principle according to the first aspect can be used to encode any multi-channel format audio data.

In a second aspect, the invention provides an audio decoder for generating a multi-channel audio signal based on an encoded signal, the decoder comprising:

a decoder combination module for generating first and second audio signals based on a dominant signal part, a residual signal part and first and second spatial parameter sets, the spatial parameters comprising a description of spatial properties of the first and second audio signals, wherein the residual signal part and the second spatial parameters are involved in determining a mixing matrix that is used to generate the first and second audio signals.

As described in connection with the first aspect, existing decoders can be used to decode the encoded output signal from an encoder according to the invention by only utilizing the dominant signal part and first spatial parameters. However, the decoder according to the second aspect will be able to utilize the second encoded output part, i.e. the residual signal part and a spatial parameter, to determine a mixing matrix that is identically inverse to the encoder combination involved in the encoding process, and thus a perfect regeneration of the first and second audio signals can be obtained.

In preferred embodiments, the decoder comprises a decorrelator for receiving the dominant signal part and generate a de-correlated dominant signal part in response thereto. Preferably, an addition of the residual signal part and the decorrelated dominant signal part is involved in determining the mixing matrix. The decoder may comprise an attenuator for attenuating the de-correlated dominant signal part prior to adding it to the residual signal part.

In preferred embodiments, the mixing matrix applies a rotation in a two-dimensional signal space to the dominant and residual signal parts.

The decoder may be adapted to receive a plurality of sets of first and second sets of parameters and a plurality of residual signal part so as to generate a plurality of sets of first and second audio signals in response thereto. In a preferred embodiment, the decoder is adapted to receive three sets of first and second sets of parameters and three residual signal parts so as to generate three sets of first and second audio signals in response thereto, in this embodiment, the decoder can generate six independent audio channels, such as according to the 5.1 format or other multi-channel format.

In preferred embodiments the decoder comprises a plurality of one-to-two channel mixing-matrices arranged in a suitable configuration so as to enable the decoder to decode an encoded signal representing more than two audio signals. For example the decoder may comprise a configuration of five mixing-matrices arranged to generate six audio signals and thus decode e.g. an encoded 5.1 audio signal.

In a third aspect, the invention provides a method of encoding a multi-channel audio signal comprising the steps of 1) generating a dominant signal part and a residual signal part being a combined representation of the first and second audio signals, the dominant and residual signal parts being obtained by applying a mathematical procedure to the first and second audio signals, wherein the mathematical procedure involves a first spatial parameter comprising a description of spatial properties of the first and second audio signals, 2) generating a first parameter comprising a second spatial parameter, 3) generating a second parameter comprising a third spatial parameter, and 4) generating an encoded output signal comprising a first output part comprising the dominant signal part and the first parameter set, and a second output part comprising the residual signal part and the second parameter set.

The same advantages and comments as described in connection with the first aspect applies to the third aspect.

In a fourth aspect, the invention provides a method of generating a multi-channel audio signal based on an encoded signal, the method comprising the steps of:

1) receiving the encoded signal comprising a dominant signal part, a residual signal part, and first and second spatial parameters comprising a description of spatial properties of first and second audio signals, 2) determining a mixing matrix based on the residual signal part and the second spatial parameter, 3) generating the first and second audio signals based on the determined mixing matrix.

The method may comprise the step of de-correlating the dominant signal part and generating a de-correlated dominant signal part in response thereto. The method may further comprise the step of adding the residual signal part and the decorrelated dominant signal part. The determining of the mixing matrix may be based on the added residual signal part and the de-correlated dominant signal part.

Preferably, the method comprises receiving a plurality of sets of first and second sets of parameters and a plurality of residual signal part so as to generate a plurality of sets of first and second audio signals in response thereto. In a preferred embodiment, the method comprises receiving three sets of first and second sets of parameters and three residual signal parts so as to generate three sets of first and second audio signals in response thereto. In this embodiment, the method is capable of generating six independent audio channels such as in a 5.1 multi-channel format or equivalent.

The same advantages and comments as described for the second aspect apply for the fourth aspect.

In a fifth aspect, the invention provides an encoded multi-channel audio signal comprising a first signal part comprising a dominant signal part and a first parameter set comprising a description of spatial properties of first and second audio signals, and a second signal part comprising a residual signal part and a second parameter set comprising a description of spatial properties of first and second audio signals.

The audio signal according to the fifth aspect provides the same advantages as set forth in connection with the first aspect, since this signal is identical with an encoded output signal from the encoder according to the first aspect. Thus, the encoded multi-channel audio signal according to the fifth aspect is a scalable signal since the first signal part, adapted for a base layer, is mandatory, while the second signal part, adapted for a refinement layer, is optional and is only required for optional signal quality.

In a sixth aspect, the invention provides a storage medium having stored thereon a signal as in the fifth aspect. The storage medium may be a hard disk, a floppy disk, a CD, a DVD, an SD card, a memory stick, a memory chip etc.

In a seventh aspect, the invention provides a computer executable program code adapted to perform the method according to the first aspect.

In an eighth aspect, the invention provides a computer readable storage medium comprising a computer executable program code according to the seventh aspect. The storage medium may be a hard disk, a floppy disk, a CD, a DVD, an SD card, a memory stick, a memory chip etc.

In a ninth aspect, the invention provides a computer executable program code adapted to perform the method according to the fourth aspect.

In a tenth aspect, the invention provides a computer readable storage medium comprising a computer executable program code according to the ninth aspect. The storage medium may be a hard disk, a floppy disk, a CD, a DVD, an SD card, a memory stick, a memory chip etc.

In an eleventh aspect, the invention provides a device comprising an encoder according to the first aspect. The device may be such as home entertainment audio equipment such as surround sound amplifiers, surround sound receivers, DVD players/recorders etc. In principle the device may be any audio device capable of handling multi-channel audio data, e.g. 5.1 format.

In a twelfth aspect, the invention provides a device comprising a decoder according to the second aspect. The device may be such as home entertainment audio equipment such as surround sound amplifiers, surround sound receivers, A/V receivers, set-top boxes, DVD players/recorders etc.

The signal according to the fifth aspect is suitable for transmission through a transmission chain. Such transmission chain may comprise a server storing the signals, a network for distribution of the signals, and clients receiving the signals. The client side may comprise hardware such as e.g. computers, A/V receivers, set-top boxes, etc. Thus, the signal according to the fifth aspect is suitable for transmission of Digital Video Broadcasting, Digital Audio Broadcasting or Internet radio etc.

It is appreciated that in all of the above aspects, the first and second audio signals may be full bandwidth signals. Optionally, the first and second audio signals represent sub-band representations of respective full bandwidth audio signals. In other words, the signal processing according to the invention may be applied on full bandwidth signals or applied on a sub-band basis.

Figure 2:
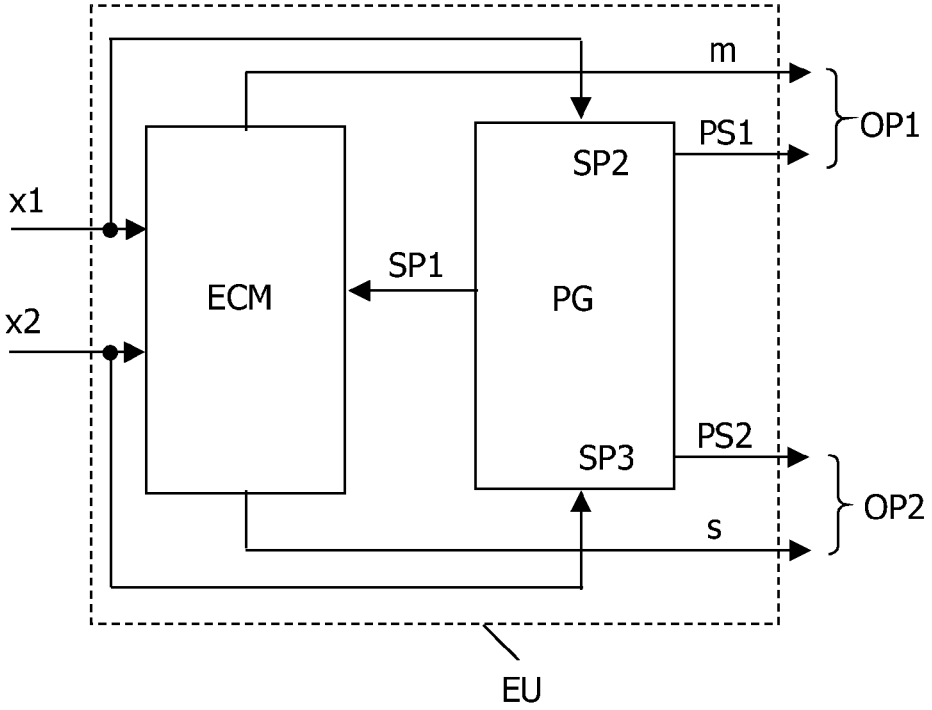
Figure 3:
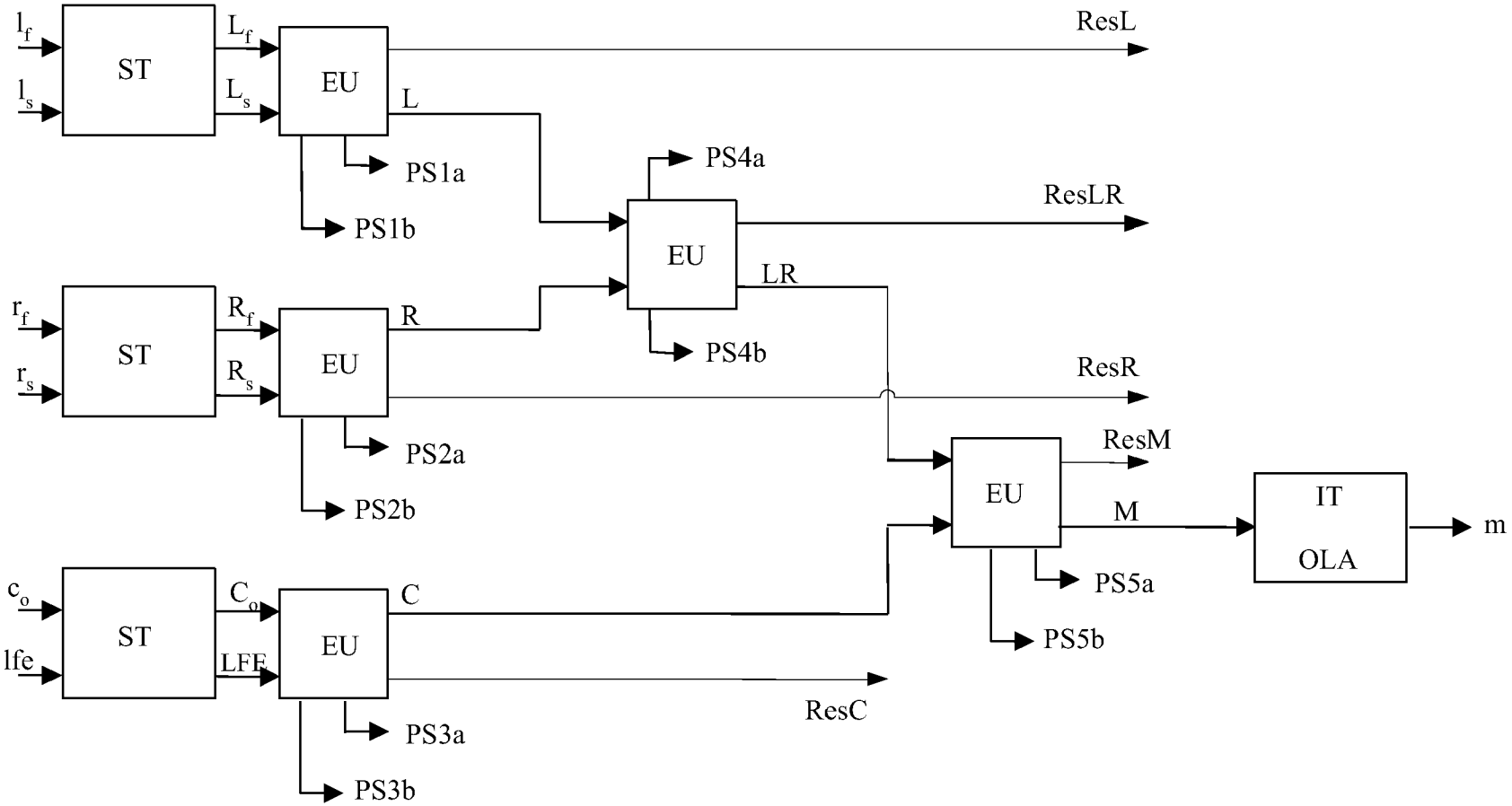
Figure 4:
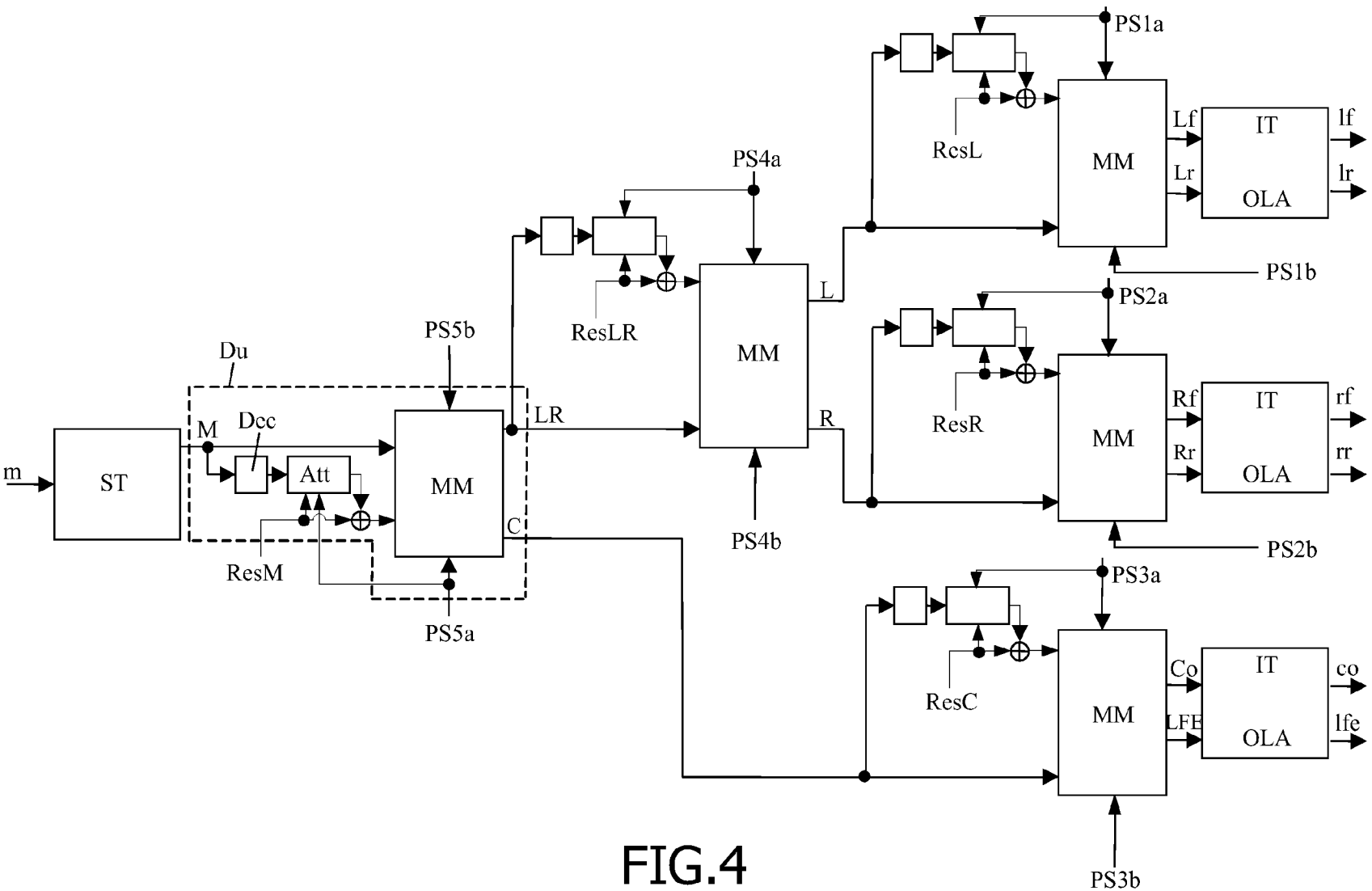
Figure 5:
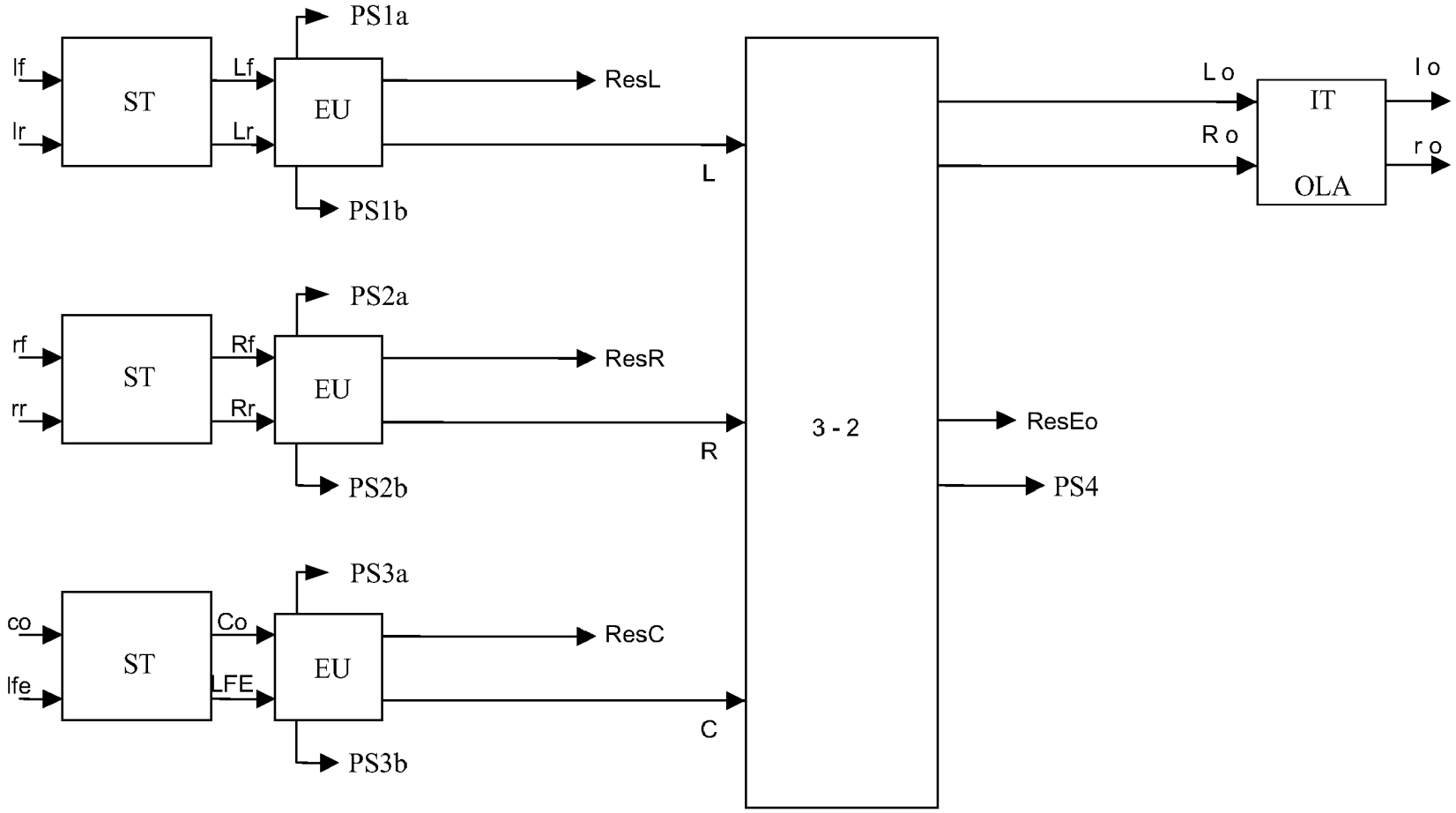
Figure 6:
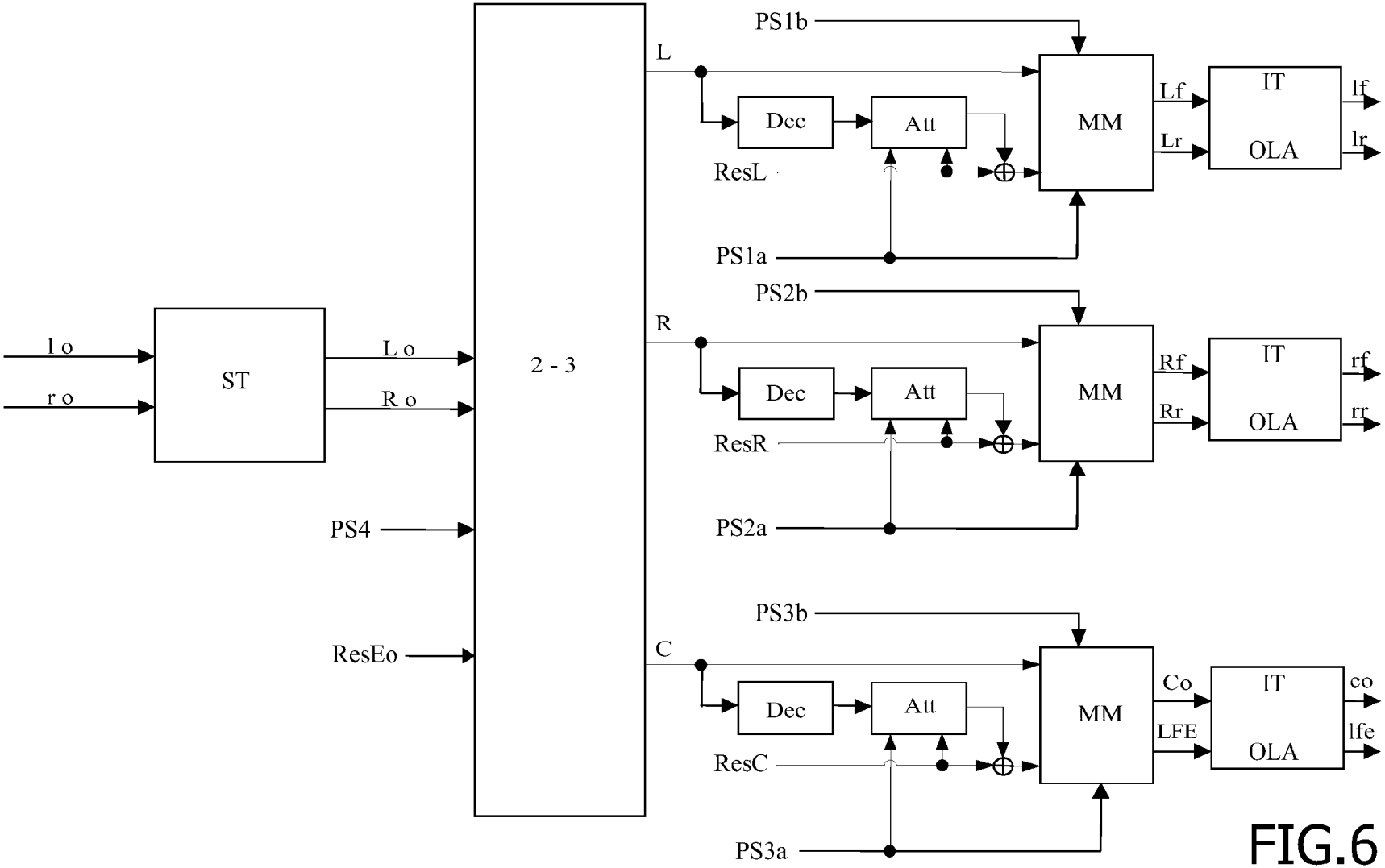
Figure 7:
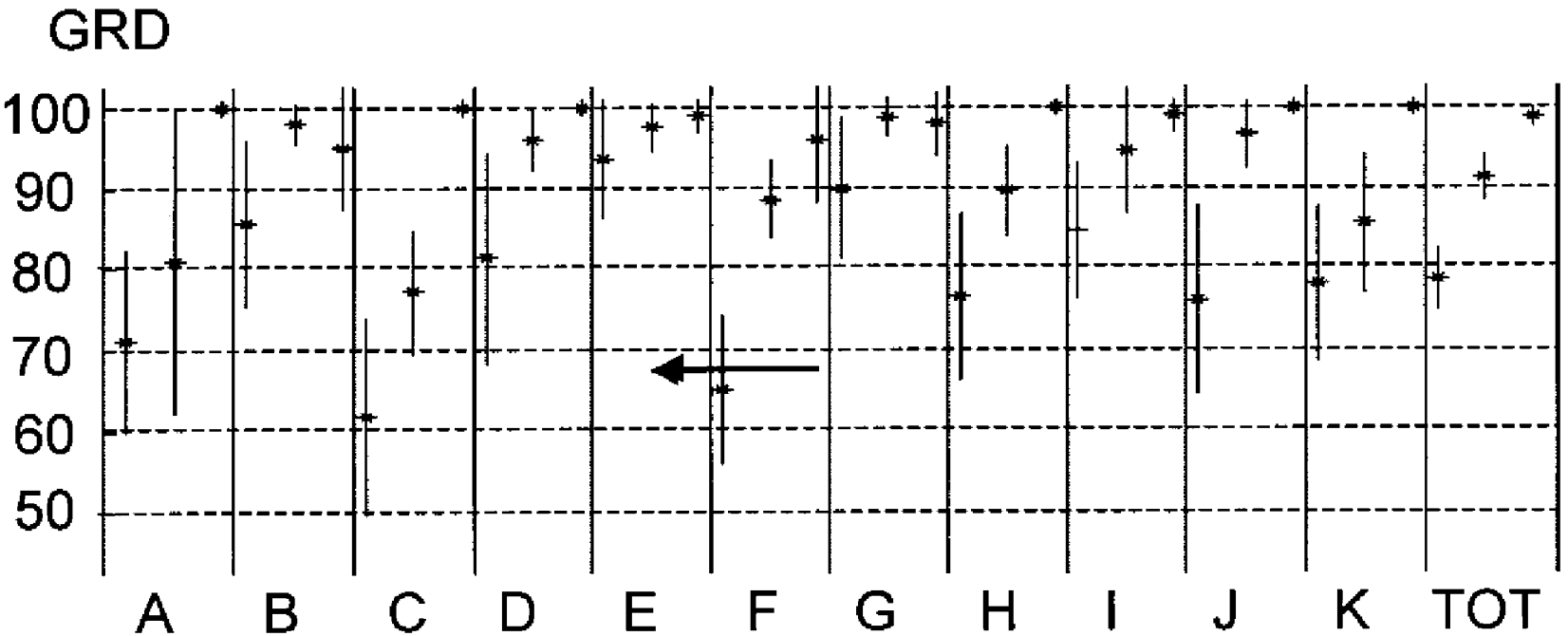

In the following the invention is described in more details with reference to the accompanying figures, of which FIG. 1 shows a sketch of a 5.1 multi channel loudspeaker setup, FIG. 2 shows an encoder combination unit according to the invention, FIG. 3 shows a preferred encoder for encoding a 5.1 audio signal based on an encoder combination to a mono signal, FIG. 4 shows a preferred decoder corresponding to the encoder of FIG. 3, FIG. 5 shows a preferred encoder for encoding a 5.1 audio signal based on an encoder combination to a stereo signal, FIG. 6 shows a preferred decoder corresponding to the encoder of FIG. 5, and FIG. 7 shows a graph illustrating results of a listening test performed with the encoding principle according to the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

FIG. 1 shows a sketch of a typical 5.1 multi-channel audio setup with a listening person LP positioned in the centre of five loudspeakers C, Lf, Ls, Rf and Rs that receive independent audio signals. These are provided to yield the listening person LP a spatial audio impression. The 5.1 setup in addition provides a separate subwoofer LFE signal. Thus, a full signal representation for such a multi-channel setup requires altogether six independent audio channels, and thus a large bit rate is necessary to represent an audio signal for such a system at full audio quality. In the following, embodiments of the invention will be described that are capable of providing a high audio quality in a 5.1 system at a low bit rate.

FIG. 2 shows a 2-1 encoder combination unit EU according to the invention. First and second audio signals x1, x2 are input to an encoder combination module ECM where a mathematical procedure is performed on the first and second audio signals x1, x2, preferably comprising a signal rotation, in order to combine the first and second audio signals x1, x2 and generate a parametric representation thereof comprising a dominant signal part m and a residual signal part s. A first spatial parameter SP1, i.e. a parameter describing spatial signal properties of the first and second audio signals x1, x2, is involved in the mathematical encoder combination procedure.

A parameter generator PG generates first and second parameter sets PS1, PS2 based on the first and second audio signals x1, x2. The first parameter set PS1 comprises a second spatial parameter SP2, and the second parameter set PS2 comprises a third spatial parameter SP3. The encoded output signal comprises a first output part OP1 comprising the dominant signal part m and the first parameter set PS1, while a second output part OP2 comprises the residual signal part s and the second parameter set PS2.

By proper choice of the second and third spatial parameters SP2, SP3 in relation to the first spatial parameter SP1 it is possible to perform an inverse of the encoder combination or rotation procedure at the decoder side, and thus the first and second audio signals x1, x2 can be transparently decoded.

Preferably, the encoder puts the first output part in a base layer of its output bit stream, while the second output part is put into a refinement layer of the output bit stream. During decoding it is possible to use only the base layer, if a reduced signal quality is acceptable, while the best possible signal quality can be obtained if also the refinement layer is included in the decoding process.

The encoding principle described provides a scalable hybrid multi-channel audio encoder with full backwards compatibility. The decoder can be used for the following scenarios: 1) Decoded mono or stereo signal only, 2) Decoded multi-channel output without the use of residual signals, and 3) Decoded multi-channel output with residual signals.

In the following preferred embodiments of encoder combination modules and spatial parameters are described. A preferred encoder combination module combines first and second audio signals x1, x2 to a dominant signal part m and residual signal part s by maximizing the amplitude of the sum of the rotated signals according to:

$$\begin{pmatrix} m[k] \\ s[k] \end{pmatrix} = \begin{pmatrix} sc_{corr} & sc_{corr} \\ \frac{1}{2} & -\frac{1}{2} \end{pmatrix} \begin{pmatrix} x_1[k] \\ x_2[k] \end{pmatrix}, \text{ where} \quad \text{(Eq 1)}$$

$$sc_{corr} = \min\left\{sc_{corr,max}, \frac{1}{c_l\cos(\chi+\beta) + c_r\cos(-\chi+\beta)}\right\}.$$

The amplitude rotation coefficients involved in $sc_{corr}$ are derived from ICC and IID, i.e. they are based on spatial properties of the first and second audio signals x1, x2. These amplitude rotation coefficients are preferably calculated according to:

$$\chi = \frac{1}{2}\cos^{-1}(ICC),\ \beta = \tan^{-1}\left(\tan(\chi)\frac{c_r - c_l}{c_r + c_l}\right),$$

$$c_l = \sqrt{\frac{IID}{1+IID}},\ c_r = \sqrt{\frac{1}{1+IID}}.$$

The residual signal s is selected to be the difference between x1 and x2. Note that this matrix is always invertible, as $sc_{corr}$ can never be zero, which means that a perfect reconstruction can be achieved as long as $sc_{corr}$ is known. A suitable value for the clipping constant $sc_{corr,max}$ is 1.2.

To derive $sc_{corr}$ in the decoder, the second parameter set PS2 preferably comprises a difference between coherence and correlation parameters and thus transmitted together with the corresponding residual signal s in a refinement layer in the scalable bit stream. The first parameter set PS1 is selected to comprise either coherence parameters or correlation parameters and thus to be transmitted in the base layer together with the dominant signal part m.

When the residual signal s is available to the decoder, correlation parameters are derived, which facilitates the calculation of $sc_{corr}$, and an inverse of the mixing matrix of Eq 1 can be determined.

$$\begin{pmatrix} x_1[k] \\ x_2[k] \end{pmatrix} = \begin{pmatrix} \frac{1}{2sc_{corr}} & 1 \\ \frac{1}{2sc_{corr}} & -1 \end{pmatrix} \begin{pmatrix} m[k] \\ s[k] \end{pmatrix}.$$

In another preferred embodiment, the encoder combination module is Principal Component Analysis (PCA) based and mixes the first and second audio signals x1, x2 according to:

$$\begin{pmatrix} m[k] \\ s[k] \end{pmatrix} = \begin{pmatrix} \cos(\alpha) & \sin(\alpha) \\ -\sin(\alpha) & \cos(\alpha) \end{pmatrix} \begin{pmatrix} x_1[k] \\ x_2[k] \end{pmatrix},$$

where a preferred coefficient $\alpha$ is based on ICC and IID according to:

$$\alpha = \frac{1}{2}\tan^{-1}\left(\frac{2ICC\cdot c}{c^2-1}\right),\ c = 10^{\frac{IID}{20}}.$$

Preferred options for encoding of the second parameter set PS2 to be included in the refinement layer are correlation parameters that include the following:

1) Time- or frequency differential coding of the correlation parameters, independent of the coherence parameters in the base layer.

2) Differential coding of the correlation parameters with regard to the coherence parameters in the base layer (i.e. $\Delta ICC = ICC_{correlation} - ICC_{coherence}$).

A combination of 1 and 2, depending on which requires the least amount of bits.

3) FIGS. 3 and 4 illustrate preferred configurations of a 5.1 format encoder and a corresponding 5.1 decoder, respectively, that are based on an encoder combination to an encoded mono signal. FIGS. 5 and 6 illustrate an alternative 5.1 format encoder and a corresponding decoder, respectively, that are based on an encoder combination to an encoded stereo signal.

FIG. 3 shows an encoder configuration based on a combination of six independent audio signals lf, ls, rf, rs, co, lfe to a mono signal m, e.g. the six audio signals represent signals lf, ls, rf, rs, co, lfe in a 5.1 format. The encoder comprises five encoder combination units EU, such as described in the foregoing, these units EU being arranged to successively combine the six signals lf, ls, rf, rs, co, lfe into a single mono signal m. An initial segmentation and transformation step ST is performed for signal pairs prior to encoder combination. This step ST comprises segmenting the time-domain audio signals into overlapping segments and then transforming these overlapping time-domain segments into frequency domain representations (indicated by capital letters).

After the segmentation and transformation ST, the two left channels Lf and Ls are combined to a dominant signal part L, first and second parameter sets PS1*a*, PS1*b* and a residual signal ResL. The two right channels Rf, Rs are combined to a dominant signal part R, first and second parameter sets PS2*a*, PS2*b* and a residual signal ResR. The resulting dominant signal parts L and R are then combined to a dominant signal part LR, a residual signal part ResLR and first and second parameters PS4*a*, PS4*b*. The centre channel C0 and the subwoofer channel LFE are combined to a dominant signal part C, first and second parameter sets PS3*a*, PS3*b* and a residual signal ResC. Finally, the dominant signal parts C and LR are combined to a dominant signal part M, residual signal part ResM and first and second parameters PS5*a*, PS5*b*.

Preferably, the first and second sets of parameters PS1*a*-PS5*a*, PS1*b*-PS5*b* are determined independently for a number of frequency bands (sub-bands) in a segment before quantization, coding and transmission, however if preferred, the processing may be performed on full bandwidth signals. After signal analysis and processing is applied, an optional processing may be applied IT, OLA: segments may be inverse transformed IT back into the time domain, and segments may be overlapped and added OLA to obtain the time-domain mono audio signal m. Altogether the encoder generates a first output part comprising the dominant signal part m and five parameter sets PS1*a*-PS5*a*, and a second output part comprising five residual signal parts ResL, ResR, ResLR, ResM, ResC, and five parameter sets PS1*b*, PS5*b*.

FIG. 4 shows a decoder corresponding to the encoder of FIG. 3, i.e. it is adapted to receive the output signal from the encoder of FIG. 3. The decoder essentially applies the inverse of the processing described for FIG. 3. The decoder comprises an (optional) initial segmentation and frequency transformation ST is applied to the dominant signal part m. The decoder comprises five similar decoder combination units DU, of which one is indicated with a dashed line. The decoder combination unit DU comprises a mixing-matrix MM that generates first and second signals based on a dominant signal part. The mixing-matrix MM, i.e. the inverse of the mixing matrix applied in the encoder combination module ECM, is determined based on received dominant signal part, residual part and first and second parameter sets.

In the first decoder combination unit DU indicated in FIG. 4, the dominant signal M is first de-correlated in a de-correlator Dec and then attenuated in an attenuator Att. The decorrelated and attenuated dominant signal part is then added to the residual signal part ResM. This added signal is then used to determine the mixing-matrix MM. The attenuator Att is set in response to the residual signal part ResM and the first parameter set PS5*a*. Finally, the mixing-matrix MM is determined using the first and second parameter sets PS5*a*, PS5*b*. The determined mixing-matrix MM then combines the dominant signal part M to a first output signal LR and a second output signal C. These first and second output signals LR, C are then applied to respective encoder combination units and successively combined to yield L, R, and C0, LFE, respectively. Finally, L is decoder combined to yield Lf and Lr, while R is decoder combined to yield Rf and Rr. After signal analysis and processing is applied, segments are inverse transformed IT back into the time domain, and segments are overlapped and added OLA to obtain the time-domain representations lf, lr, rf, rr, co, lfe. This inverse transformation and overlap-add IT, OLA are optional.

FIG. 5 show an encoder embodiment where three encoder combination units, each functioning according to the principles described in connection with the encoder of FIG. 3, are used to combine six audio signals Lf, Lr, Rf, Rr, C0, LFE in pairs to three dominant signal parts L, R, C with associated first parameter sets PS1*a*-PS3*a*, second parameter sets PS1*b*-PS3*b* and residual signal parts ResL, ResR, ResC. A 3-2 encoder combination unit is then applied to the three dominant signal part L, R and C resulting in two dominant signal parts L0, R0 and residual signal part ResEo and a parameter set PS4. Optionally, an initial segmentation and frequency domain transformation ST is applied, and a final inverse transformation IT and overlap-add OLA is (optionally) applied, such as also described in connection with FIG. 3.

FIG. 6 shows a decoder configuration adapted to decode an output from the encoder of FIG. 5. After an (optional) initial segmentation and frequency domain transformation ST of input signals lo, ro, a 2-3 decoder combination module generates dominant signal parts L, R, C in response to dominant signal parts Lo, Ro, residual signal part ResEo together with parameter set PS4. These three dominant signal parts L, R, C are then processed in respective decoder combination units similar to the decoder combination units DU described in connection with the decoder of FIG. 4. A final inverse transformation IT and overlap-add OLA is (optionally) applied as also described above.

FIG. 7 illustrates results of a listening test performed for five trained listeners. The musical items A-K used are those specified in the MPEG "Spatial Audio Coding" work item. For each item A-K, results for three encoded versions were included in the test: 1) Decoder without residuals—shown to the left, 2) Spatial encoder with residuals, i.e. a decoder according to the invention—shown in the middle, and 3) Reference (hidden)—shown to the right,—shown to the right. A total average of the items A-K is shown as TOT. For each encoded version an average grade GRD is indicated with an asterisk (*), while +/− standard deviation for answers within listeners are indicated therefrom.

For scenario 2) and 3) the encoder/decoder principle illustrated in FIGS. 5 and 6 was used. In scenario 2) residual signal parts were discarded. For scenario 3), three residual signal parts band limited to 2 kHz, were used: Residual signal part for left channel ResL, residual signal part for right channel ResR, and residual signal part ResEo for the decoder combination module 3-2. Each one of the residual signals ResL, ResR, ResEo was coded at a bit rate of 8 kbit/s, and the extra spatial parameters (being differences between correlation (refinement layer) and coherence parameters (base layer)) required an estimated bit rate of 700 bit/s. Hence, the total extra residual-related bit rate is then approximately 25 kbit/s. The standard spatial parameters (to be placed in the base layer), required an estimated 10 kbit/s. The total spatial data rate is thus approximately 35 kbit/s. No core codec was applied to the stereo signal lo, ro.

From the results, it is clear that a large quality improvement can be obtained by utilizing three residual signals coded at a low bit rate. Furthermore, the total average quality grade is +/−92, very close to what is considered "transparent" audio quality.

The encoder and decoder according to the invention may be applied within all applications involving multi-channel audio coding, including: Digital Video Broadcasting (DVB), Digital Audio Broadcasting (DAB), Internet radio, Electronic Music Distribution.

Reference signs in the claims merely serve to increase readability. These reference signs should not in anyway be construed as limiting the scope of the claims, but are only included illustrating examples only.

The invention claimed is:

1. An audio decoder for generating a multi-channel audio signal based on an encoded signal including a dominant signal part, a residual signal part and first and second parameters, the decoder comprising:

a decoder combination unit for receiving a frequency transformed dominant signal part and for generating first and second audio signals, said decoder combination unit comprising:

a de-correlator for decorrelating the frequency transformed dominant signal part and for generating a decorrelated dominant signal part, an attenuator for attenuating the decorrelated dominant signal part and the residual signal part in accordance with the first parameters to provide an attenuation result, and a mixing matrix for combining the frequency transformed dominant signal part, the residual signal part, and the attenuation result in accordance with the first and second parameters to form the first and second audio signals, the first and second parameters comprise a description of spatial properties of the first and second audio signals.

2. The audio decoder as claimed in claim 1, wherein the decoder combination unit further comprises an adder for adding the residual signal part and the attenuation result and providing an adding result to the mixing matrix.

3. The audio decoder as claimed in claim 2, wherein the attenuation result is provided prior to the adding result.

4. The audio decoder as claimed in claim 1, wherein the audio decoder receives a plurality of first and second parameters and a plurality of residual signal parts, and generates a plurality of first and second audio signals in response thereto.

5. The audio decoder as claimed in claim 4, wherein the decoder receives three sets of first and second parameters and three residual signal parts, and generates three sets of first and second audio signals in response thereto.

6. A method of generating a multi-channel audio signal from an encoded signal, the method comprising acts of:

receiving the encoded signal comprising a dominant signal part, a residual signal part, first and second parameters comprising a description of spatial properties of first and second audio signals, and a frequency transformed dominant signal part;

decorrelating the frequency transformed dominant signal part to generate a decorrelated dominant signal part;

attenuating the decorrelated dominant signal part and the residual signal part in accordance with the first parameters to provide an attenuation result, combining using a mixing matrix the frequency transformed dominant signal part, the residual signal part and the attenuation result in accordance with the first and second parameters; and generating the first and second audio signals.

7. The method as claimed in claim 6, wherein said act of: de-correlating includes an act of using a de-correlator.

8. The method as claimed in claim 7, further comprising an act of adding the residual signal part and the attenuation result.

9. The method as claimed in claim 8, wherein the attenuation result is provided prior to the adding result.

10. The method as claimed in claim 6, wherein said receiving act comprises receiving a plurality of first and second parameters and a plurality of residual signal parts so as to generate a plurality of sots of first and second audio signals in response thereto.

11. The method as claimed in claim 6, wherein said receiving step act comprises receiving three sets of first and second parameters and a three residual signal parts so as to generate three sets of first and second audio signals in response thereto.

12. A non-transitory computer-readable storage medium comprising a computer program having computer executable program code for configuring a computer, when executing the computer program, to perform a method of generating a multi-channel audio signal from an encoded signal, the method comprising acts of:

receiving the encoded signal comprising a dominant signal part, a residual signal part, first and second parameters comprising a description of spatial properties of first and second audio signals, and a frequency transformed dominant signal part;

decorrelating the frequency transformed dominant signal part to generate a decorrelated dominant signal part;

attenuating the decorrelated dominant signal part and the residual signal part in accordance with the first parameters to provide an attenuation result, combining using a mixing matrix the frequency transformed dominant signal part, the residual signal part and the attenuation result in accordance with the first and second parameters; and generating the first and second audio signals.

* * * * *